US009433249B2

(12) United States Patent
Ranzau

(10) Patent No.: US 9,433,249 B2
(45) Date of Patent: Sep. 6, 2016

(54) TOOLS FOR MAKING BOWS AND METHODS OF USE

(76) Inventor: Karyn E. Ranzau, Louisville, KY (US)

( * ) Notice: Subject to any disclaimer, the term of this patent is extended or adjusted under 35 U.S.C. 154(b) by 934 days.

(21) Appl. No.: 13/548,179

(22) Filed: Jul. 12, 2012

(65) Prior Publication Data

US 2013/0015214 A1 Jan. 17, 2013

Related U.S. Application Data

(60) Provisional application No. 61/508,451, filed on Jul. 15, 2011.

(51) Int. Cl.
*A41D 25/08* (2006.01)
*D04D 7/10* (2006.01)

(52) U.S. Cl.
CPC ..... *A41D 25/08* (2013.01); *D04D 7/10* (2013.01)

(58) Field of Classification Search
CPC ..... A41D 25/08; D04D 7/10
USPC ..... 223/46
See application file for complete search history.

(56) References Cited

U.S. PATENT DOCUMENTS 2,828,896 A * 4/1958 Hanselman ..... D04D 7/10 223/46
3,021,038 A * 2/1962 Dean ..... D04D 7/10 223/46
3,193,162 A * 7/1965 Montoya ..... D04D 7/10 223/46
3,229,870 A * 1/1966 Capstick ..... D04D 7/10 223/46
3,411,677 A * 11/1968 Bickner ..... D04D 7/10 223/46
3,527,392 A * 9/1970 Thayer ..... D04D 7/10 223/46
4,651,908 A * 3/1987 Ford ..... D04D 7/10 223/46
D614,858 S * 5/2010 Ranzau ..... D3/26
D670,580 S * 11/2012 Ranzau ..... D10/64
D682,125 S * 5/2013 Ranzau ..... D10/64
2011/0024467 A1* 2/2011 Fuentes ..... D04D 7/10 223/46
2013/0015214 A1* 1/2013 Ranzau ..... D04D 7/10 223/46

* cited by examiner

*Primary Examiner* — Shaun R Hurley
*Assistant Examiner* — Andrew W Sutton
(74) *Attorney, Agent, or Firm* — Dinsmore & Shohl LLP

(57) ABSTRACT

Bow making tools and methods of using the same comprising templates and size guides for crafting bows by hand is disclosed. In some embodiments, the template may comprise a non-rectangular body having (i) a front face, (ii) a back face, and (iii) a plurality ribbon positioning surfaces; a plurality of ribbon securing elements; and optionally, one or more apertures defined within the body. In some embodiments, the size guide may comprise a non-rectangular body having (i) a front face, (ii) a back face, and (iii) a plurality sides; a plurality of ribbon positioning surfaces; optionally, at least one slot defined within the body; and optionally, a combination element comprising at least one ribbon positioning surface and at least one slot. Method of using the provided templates, size guides, or combination thereof, to construct bows are also disclosed.

11 Claims, 7 Drawing Sheets

TOOLS FOR MAKING BOWS AND METHODS OF USE

CROSS-REFERENCE TO RELATED APPLICATIONS

This application claims the benefit of priority under 35 U.S.C. Section 119(e) of U.S. Provisional Patent Application No. 61/508,451, filed on Jul. 15, 2011.

BACKGROUND

Bows are seen on a wide variety of items, including but not limited to, bags, pins, clothes (such as sweaters, dresses, shoes, and hats), gifts, backpacks, magnets, books, and home décor items. While bows can be used merely as decorations, they can also be used as in a functional manner. For example, bows may adorn and decorate hair accessories or they may be used as hair accessories themselves. Although a wide variety of uses for bows are known, uniform methods of constructing bows by hand are not well known.

The art of constructing bows by hand can be difficult to learn, especially when learning how to construct bows of different styles, shapes, and sizes. Moreover, the process of constructing bows of uniform shape and size can be a difficult and time-consuming process in which mistakes are common. Thus, ongoing needs exist for devices and methods to enhance the ability of a user to learn the art of constructing bows, to enhance the efficiency of constructing bows, and to enhance the uniformity of construction of bows.

SUMMARY

These needs are met, at least in part, by embodiments of the present disclosure, which provides bow making tools and methods of using the same. Such tools and methods are particularly useful for the construction of bows by hand.

In some of the various embodiments, provided are templates for crafting bows. Such templates may, in some embodiments, comprise a non-rectangular body having (i) a front face, (ii) a back face, and (iii) a plurality ribbon positioning surfaces; a plurality of ribbon securing elements; and optionally, one or more apertures defined within the body.

In some of the various embodiments, also provided are size guides for making bows. A provided size guide may, in some embodiments, comprise a non-rectangular body having (i) a front face, (ii) a back face, and (iii) a plurality sides; a plurality of ribbon positioning surfaces; optionally, at least one slot defined within the body; and optionally, a combination element comprising at least one ribbon positioning surface and at least one slot.

In some of the various embodiments, further provided are methods of using the provided templates, size guides, or combination thereof, to construct bows.

BRIEF DESCRIPTION OF THE DRAWINGS

A more complete appreciation of the invention and the many embodiments thereof will be readily obtained as the same becomes better understood by reference to the following detailed description when considered in connection with the accompanying drawings, wherein.

DETAILED DESCRIPTION

Specific embodiments of the present invention will now be described. The invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the specification and appended claims, the singular forms "a," "an," and "the" are intended to include the plural forms as well, unless the context clearly indicates otherwise. Unless otherwise indicated, all numbers used in the specification and claims are to be understood as being modified in all instances by the term "about."

In various embodiments of the present disclosure, provided are bow crafting templates, size guides, and methods of using of the same, individually or in combination, to construct bows.

I. Bow Crafting Templates

Figure 1:
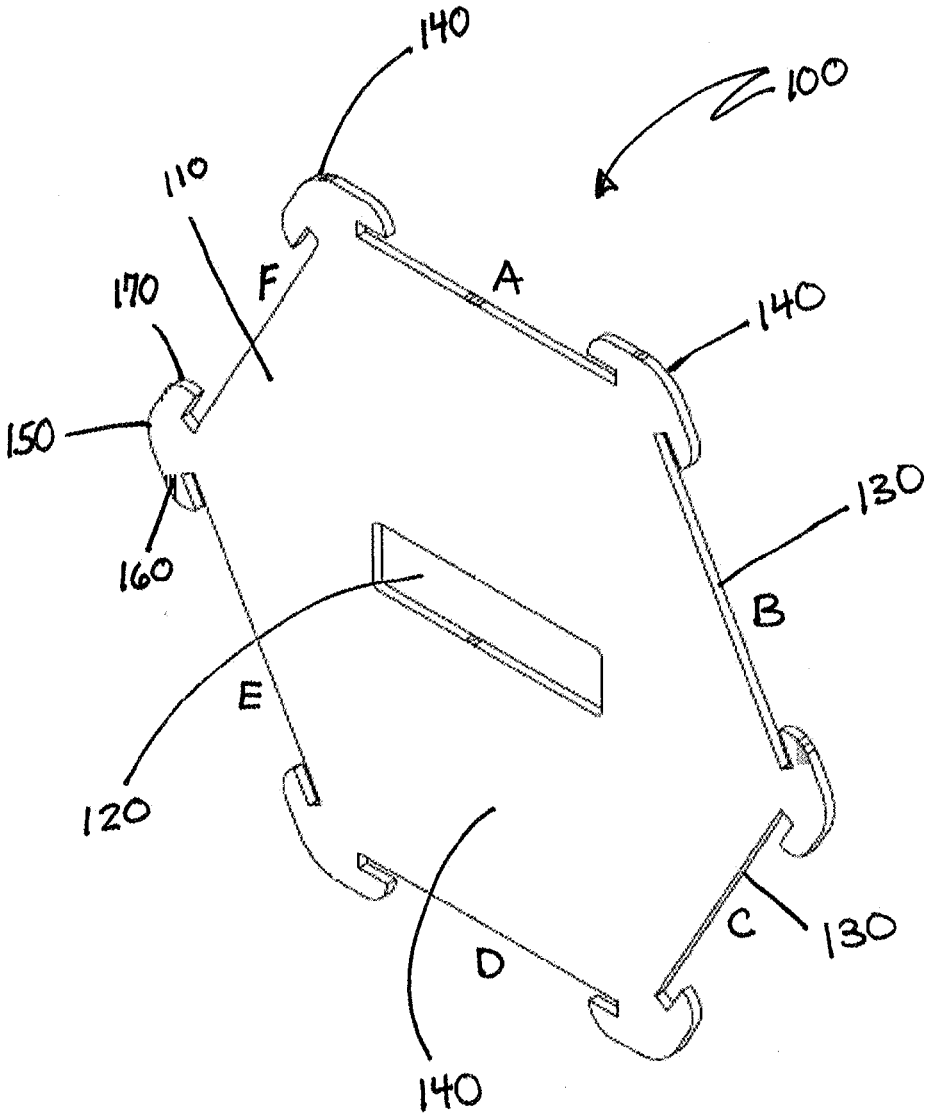
FIG. 1 is a perspective view of one example of a provided bow crafting template.
Figure 2:
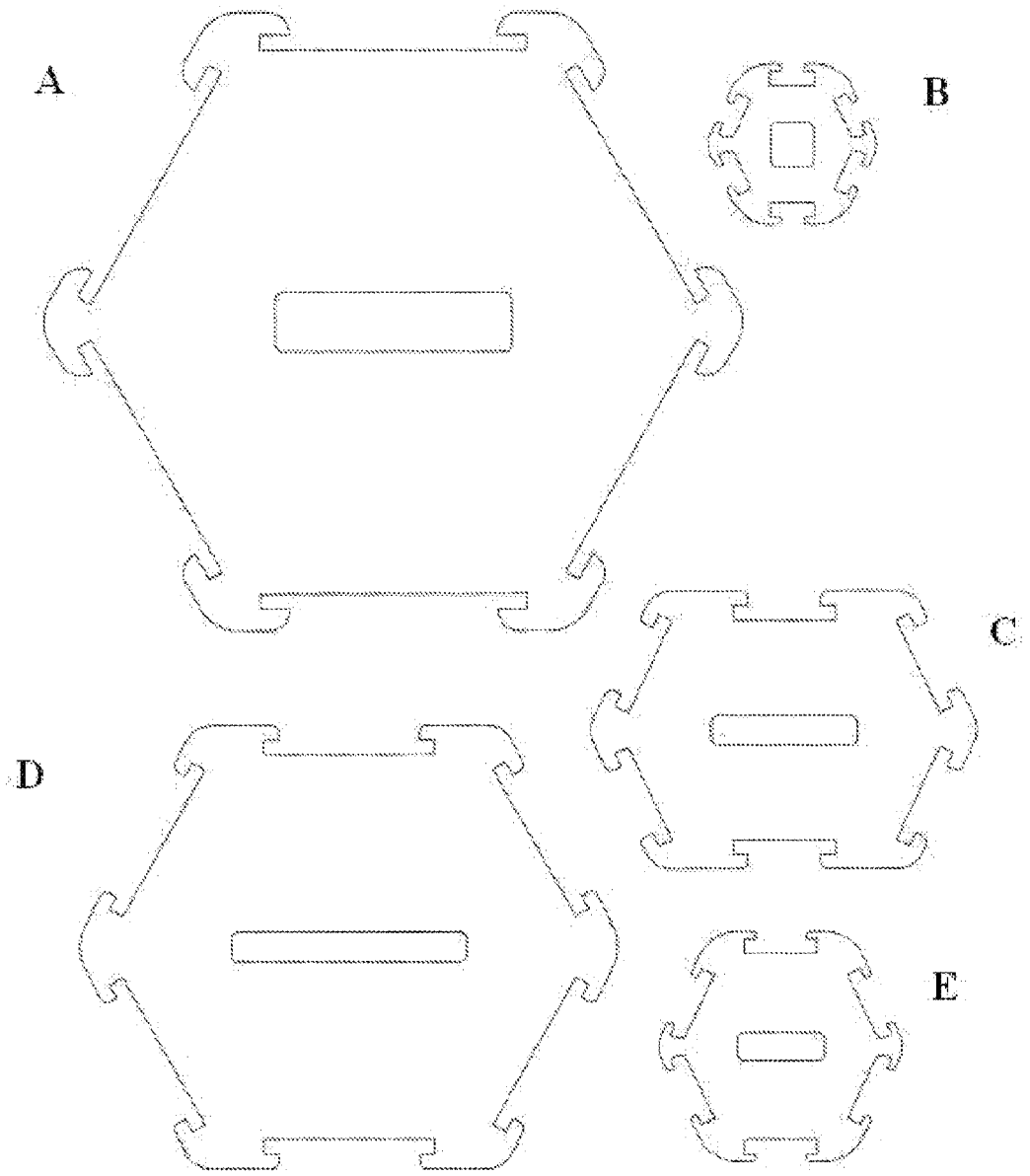
FIG. 2 illustrates various examples A-E of provided bow crafting templates, notably showing that the provided templates are not limited to (i) a particular size, (ii) a particular shape, (iii) a ribbon securing element of a particular size or shape, or (iv) an aperture of a particular size or shape.

In some of the various embodiments of the present disclosure, provided are templates for crafting bows. Without being limited as to function, said templates may guide a user to properly fold and otherwise configure bows, including how to make symmetrical ribbon loops; how to make loops having proper angles; how to make ribbon loops of one or more sizes; or combinations thereof. As will be discussed in relation to FIGS. 1-2, provided bow crafting templates may generally comprise a non-rectangular body; a plurality of ribbon securing elements; and optionally, one or more apertures defined within the body. It should be understood, however, that particular embodiments of the bow crafting templates described herein may lack one or more of the structural features set forth above and/or may incorporate additional features.

As illustrated in FIG. 1, one embodiment of bow crafting template 100 may include a body 110, an aperture 120, a plurality of ribbon positioning surfaces 130, and a plurality of ribbon securing elements 150. The body 110 is non-rectangular in shape and has (i) a front face 140, (ii) a back face (not shown) opposite thereto, and (iii) a plurality of sides A-F, each defining a ribbon positioning surface 130 between the front 140 and back faces. Each ribbon securing element 150 is positioned between two adjacent sides A-F of the body 110. Alternatively, each ribbon securing element 150 can be described as being positioned between two adjacent ribbon positioning surfaces 130. As shown, ribbon securing elements 150 can have a generally arrow shape. However, ribbon securing elements 150 are contemplated to have a variety of sizes and shapes. One example of a ribbon securing element 150 comprises a first positioning element 160 and a second positioning element 170. As shown, each positioning element 160, 170 is elevated over and substantially parallel to one substantially planar ribbon positioning surface 130. One of skill will, however, understand that the provided templates are not so limited and may have positioning elements that are not parallel with a ribbon positioning surface and may have ribbon positioning surfaces that are non-planar.

Another embodiment of bow crafting template may include a body, optional aperture, a plurality of ribbon positioning surfaces, and a plurality of ribbon securing elements, said elements not being limited with respect to shape, size and number. For example, as depicted in FIG. 2, ribbon securing elements (not labeled) may have a variety of shapes and sizes. While each template depicted in FIGS. 1-2 has a ribbon securing element comprising first and second positioning elements, the present disclosure is not limited to such design of ribbon securing elements. Rather, one of skill will appreciate that ribbon securing elements having additional (or fewer) positioning elements are also contemplated.

As depicted in FIGS. 1-2, ribbon securing elements may be elevated with respect to the rest of the body, including ribbon positioning surfaces. Such elevation allows space for a ribbon (or other suitable material) to be positioned under the positioning elements. More particularly, a ribbon positioning surface flanked on opposite ends thereof with ribbon securing elements defines a space whereby a ribbon (or other suitable material) may be positioned under two ribbon positioning elements (each being from separate ribbon securing elements) and secured between such positioning elements and the ribbon positioning surface. One of skill will, however, appreciate that the provided templates are not limited to such a configuration.

In some embodiments, a provided template comprises an aperture. In other embodiments, a provided template may lack an aperture. In yet other embodiments, a body of the provided templates may comprise more than one aperture. When present, an aperture may be circular, square, rectangular, triangular, or have any other suitable shape or size. Non-limiting examples of variations in aperture shape and size are illustrated in FIG. 2. Good results have been achieved with substantially square and substantially rectangular apertures.

As described herein, the body of a provided template is non-rectangular but can have variable size and shape. In one non-limiting example, a body of the provided templates may be substantially hexagonal in shape, said body comprising a front face, a back face, and six (6) sides. Each of said sides defines a ribbon positioning surface, thereby providing the template with six (6) ribbon positioning surfaces. However, as illustrated in FIG. 2A-E, variations in general shape and size are within the intended scope of the application. Moreover, the ribbon positioning surfaces are not limited to being planar. It is contemplated that one or more surfaces may be non-planar, including curved.

In some embodiments, the provided templates may be constructed of paper, cardboard, plastic, wood, or metal. Good results have been achieved with plastic.

II. Size Guides

In some of the various embodiments of the present disclosure, additionally provided are size guides for crafting bows. Such size guides may be used alone, or in combination with a provided bow crafting template, to configure a ribbon (or other suitable elongated material) into a bow. Without being limited as to function, the provided size guides may guide a user to properly fold and otherwise configure bows, including how to make symmetrical ribbon loops; how to make ribbon loops of one or more sizes; or combinations thereof. As will be discussed in relation to FIGS. 3-4, a provided size guide may comprise a non-rectangular body; a plurality of ribbon positioning surfaces; optionally, at least one slot defined within the body; and optionally, a combination element comprising at least one ribbon positioning surface and at least one slot. It should be understood, however, that particular embodiments of the size guides described herein may lack one or more of the features set forth above and/or may incorporate additional features.

Figure 3A:
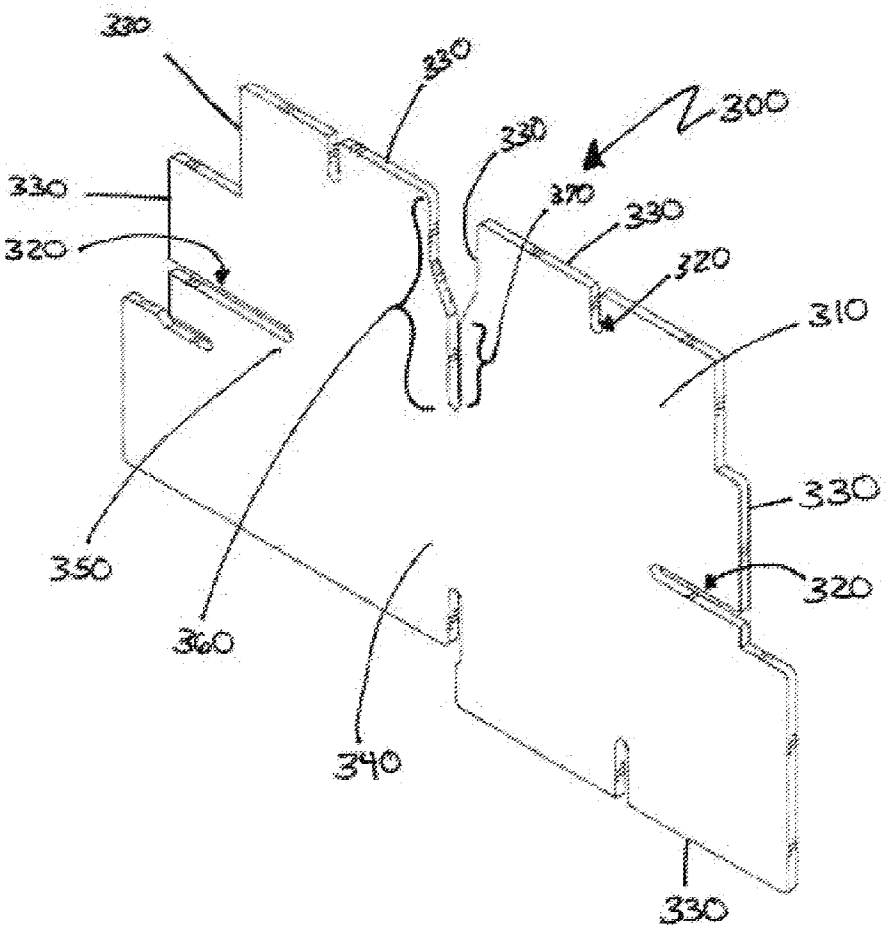
FIG. 3 illustrates A a perspective view, and B a top planar view of one example of a provided size guide tool.

As illustrated in FIG. 3, one embodiment of a size guide 300 may include a multi-sided body 310, a plurality of primary slots 320 defined within the body 310, and a plurality of ribbon positioning surfaces 330. The body 310 is non-rectangular in shape and has a front face 340 and a back face (not shown). The plurality of ribbon positioning surfaces 330 form a plurality of sides of the multi-sided body 310, and each primary slot 320 is defined in the body 310, running from a ribbon positioning surface 330 to an interior portion 350 of the body. Ribbon positioning surfaces 330 are not limited with respect to shape, size and number. In some embodiments, the provided size guide 300 may comprise at least one combination element 360 comprising at least one ribbon positioning surface 330 and at least one secondary slot 370. Slots 320, 370 are not limited with respect to shape, size, and number.

Figure 3B:
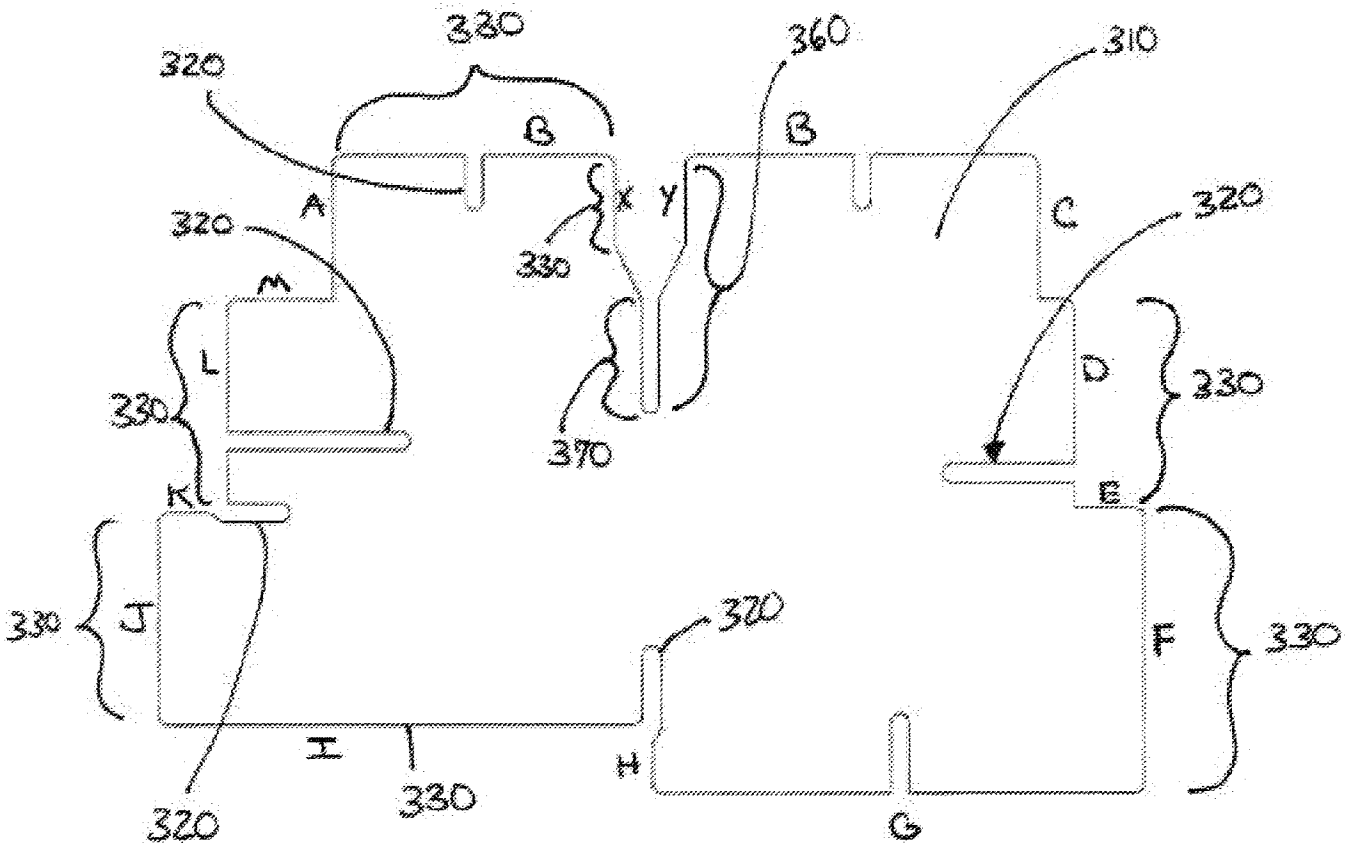

As further illustrated in FIG. 3B, one embodiment of a size guide 300 may include a multi-sided body 310 (as depicted, each side labeled as A-M); optionally, one or more primary slots 320 defined within the body 310; and a plurality of ribbon positioning surfaces 330. Optionally, the provided size guide 300 may comprise at least one combination element 350, said element comprising at least one ribbon positioning surface 330 and at least one secondary slot 370. One of skill will recognize that the ribbon positioning surface 330 of the combination element 360 (when such element 360 is present) is distinct from a side A-M. Thus, one of skill will also recognize that while a plurality of sides A-M may be ribbon positioning surfaces 330, not every side A-M is required to be such a surface 330 and not every ribbon positioning surface 330 is required to be a side A-M.

In some embodiments, a provided size guide 300 may comprise one or more primary slots 320 but not a combination element 360. In other embodiments, a provided size guide 300 may comprise one or more primary slots 320 and one or more combination elements 360. In further embodiments, a provided size guide 300 may comprise one or more combination elements 360 but lack primary slots 320.

As described herein, a body of a provided size guide generally has a multi-sided, non-rectangular shape. As one non-limiting example, a body may have a thirteen (13)-sided shape, such as that depicted in FIG. 3B (each side labeled A-M). Nine of said sides (more particularly, sides A, B, C, D, F, G, I, J, L) may also be ribbon positioning surfaces 330. In some embodiments, a body 310 may comprise at least two sides that are ribbon positioning surfaces 330. Optionally, one, two, or more additional ribbon positioning surfaces 330 may form part of the combination element 360. As depicted, X and Y are two such ribbon positioning surfaces 330 (when the combination element 360 is present). Side B of the body 310 could be considered to constitute two ribbon positioning surfaces 330 separated by the combination element 360 (when present). However, one of skill will appreciate that variations in general body shape, size, and number of ribbon positioning surfaces are within the intended scope of the application. Moreover, the ribbon positioning surfaces are not limited to being planar. It is contemplated that one or more of said surfaces may be non-planar, including curved. Although not required, good results have been achieved with sides and ribbon positioning surfaces that are substantially planar. Moreover, good results have been achieved with a body having substantially planar front and back faces (not labeled).

A provided size guide may, in some embodiments, comprise one or more primary slots defined within the body. A primary slot may generally be oval, square, or rectangular in shape, or have any other suitable shape or size. In some embodiments, a size guide may comprise one, two, three, four, five, six, seven, eight, nine, or more primary slots.

In some embodiments, a provided size guide may comprise one or more combination elements, each comprising a secondary slot. A secondary slot may generally be oval, square, or rectangular in shape, or have any other suitable shape or size. Moreover, a combination element may have any suitable size or shape, including generally V-shaped or Y-shaped. A combination element may comprise one or more ribbon positioning surfaces. In some embodiments, a combination element has two ribbon positioning surfaces.

Figure 4:
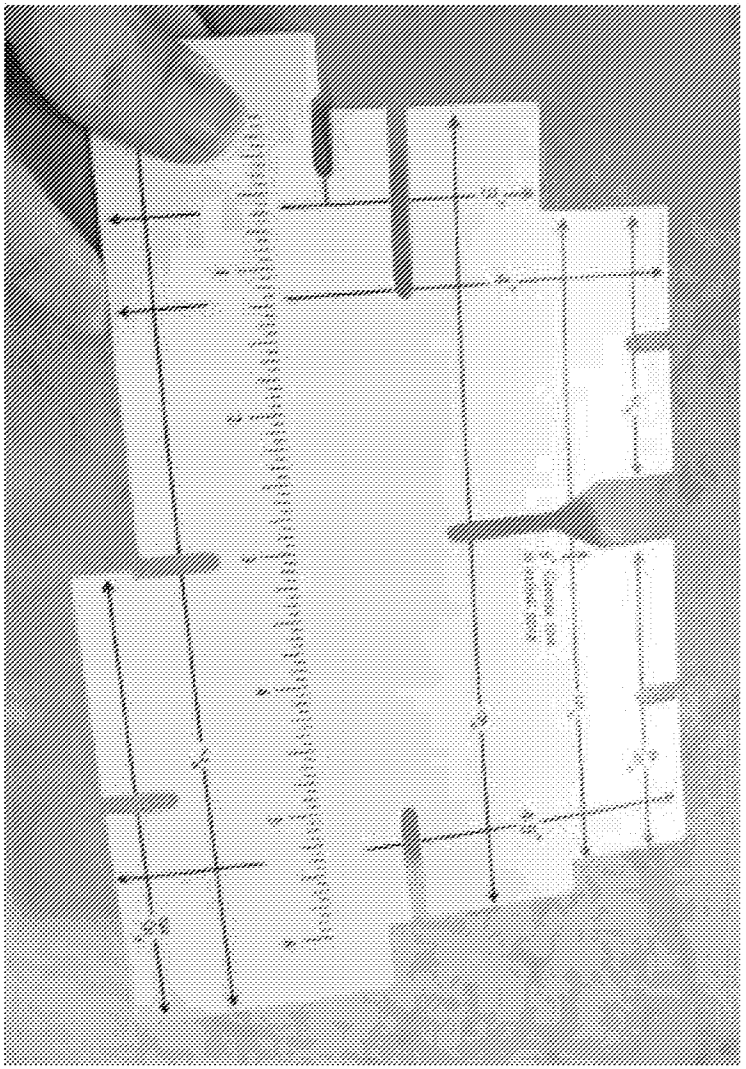
FIG. 4 illustrates one example of a provided size guide.

A provided size guide may optionally comprise one or more reference lines indicating a pre-determined distance between two ribbon positioning surfaces. In some embodiments, a provided size guide tool may optionally comprise a ruler. One example is depicted in FIG. 4.

In some embodiments, the provided size guide tools may be constructed of paper, cardboard, plastic, wood, or metal. Good results have been achieved with plastic.

III. Methods of Crafting Bows Using Bow Crafting Templates

Figure 5A:
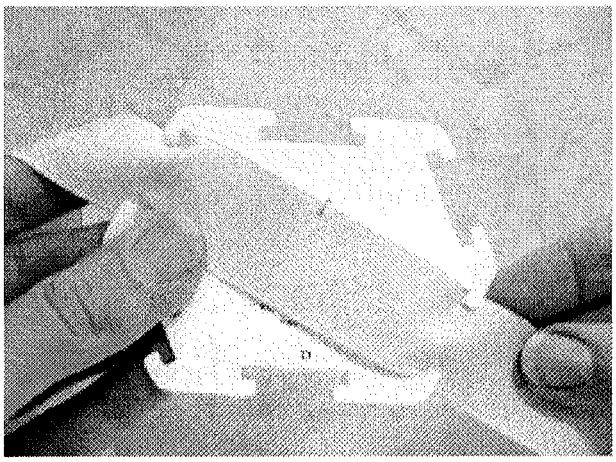
FIGS. 5A-C depict certain embodiments of how a provided bow crafting template may be used to prepare a bow.
Figure 5B:
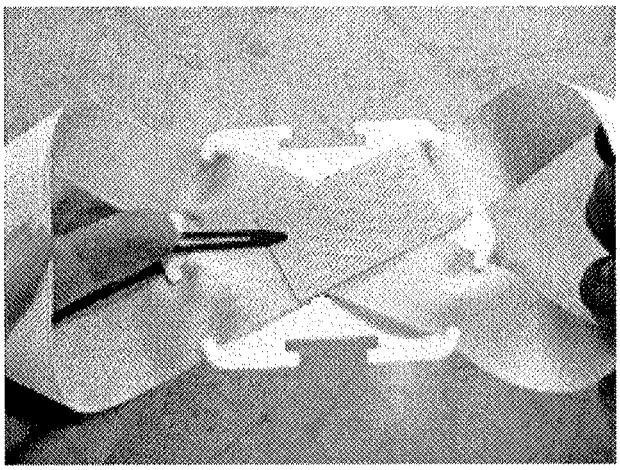
Figure 5C:
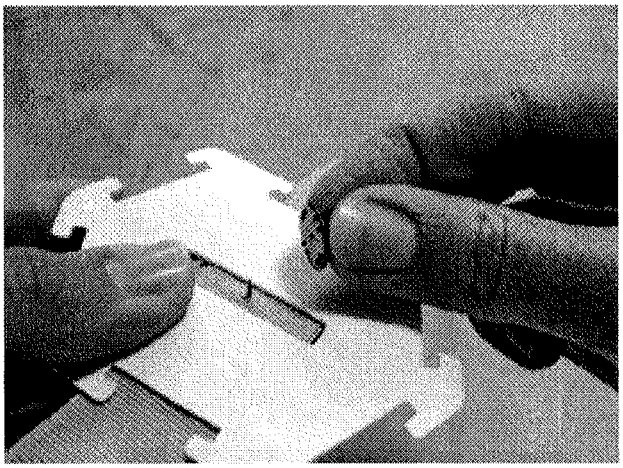

In some of the various embodiments of the present disclosure, provided are methods of crafting bows using one or more provided bow crafting templates. Referring to FIGS. 5A-C, depicted are certain embodiments of how ribbon (or any other suitable elongated article) may be manipulated and secured into a bow configuration. One of skill will appreciate that FIGS. 5A-C is not intended to be limiting and that a variety of steps and combinations thereof may be used to craft a bow and that the selection of steps will depend upon the particular bow design desired.

As depicted in FIG. 5A, a length of ribbon is provided and may be positioned across the provided template body between two ribbon positioning surfaces and loosely held in such position by two pair of ribbon securing elements. As used herein, "pair" refers to the two ribbon securing elements flanking a ribbon positioning surface. If needed to achieve the desired bow design, this process may be repeated using different parts of the ribbon and different ribbon positioning surfaces, as depicted in FIG. 5B. A length of ribbon may also be positioned across only a portion of the template body, said positioning aided by one positioning surface and one pair of ribbon securing elements. In some embodiments, a combination of the aforementioned steps is used to form the ribbon into a desired bow configuration.

One or more fasteners may be utilized to secure the ribbon into a desired configuration. Fasteners may be staples, stitching, rivets, glue, any other conventional fastener, or any combination thereof. Fastening the ribbon in a particular configuration may also be accomplished by the application of heat (such as from a wood burning device). The application of heat may melt the ribbon in specific areas, thereby securing the ribbon in a particular configuration. In some embodiments, as depicted in FIG. 5C, the fastening of the ribbon may occur in an area over and through an aperture of the template. Therefore, the ribbon may be secured to itself, but is not secured to the template, and may be easily removed from the template.

Once removed from the template, the configured ribbon may be further modified to achieve the desired bow type. For example, configured ribbon may be tied and/or cinched in the middle through employment of a tying element, such as a length of thread, string, ribbon and/or wire.

IV. Methods of Crafting Bows Using Bow Crafting Size Guides

In some of the various embodiments of the present disclosure, provided are methods of crafting bows using one or more provided bow crafting size guides, alone or in combination with a provided template. Referring to FIG. 6, depicted are certain embodiments of how ribbon (or any other suitable elongated article) may be manipulated and secured into a bow structure. One of skill will appreciate that FIG. 6 is not intended to be limiting and that a variety of steps and combinations thereof may be used to craft a bow and that the selection of steps will depend upon the particular bow design desired.

Figure 6A:
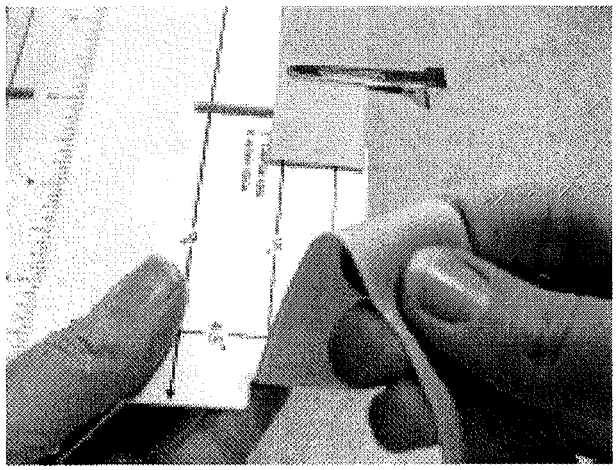
FIG. 6 depicts certain embodiments of how a provided bow crafting size guide may be used to prepare a bow.
Figure 6B:
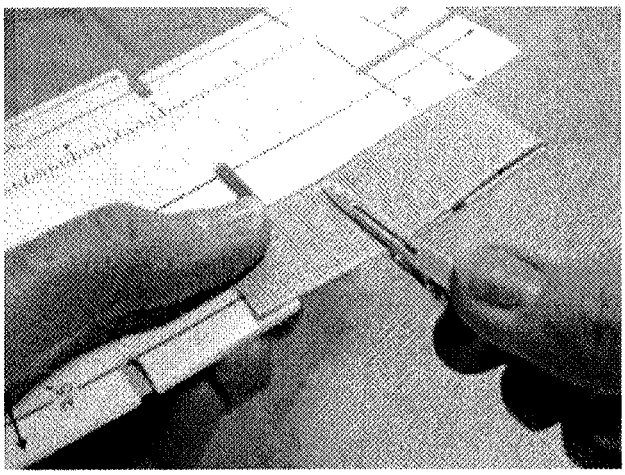
Figure 6C:
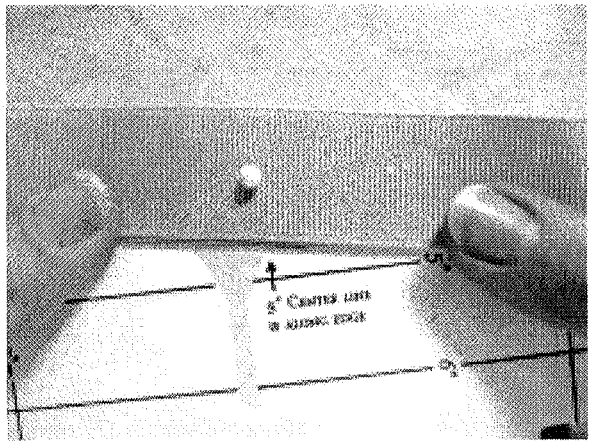

As depicted in FIG. 6A, a length of ribbon may be provided and positioned across the size guide body between two ribbon positioning surfaces. In some embodiments, as depicted in FIG. 6B, a length of ribbon may be positioned across only a portion of the body, said positioning aided by one positioning surface. In some embodiments, a combination of the aforementioned steps are used to fold the ribbon such that loop size, loop angle, loop symmetry, or combinations thereof, are in the correct configuration for the intended bow type. One or more fasteners may be utilized to secure the ribbon in such configuration, as depicted in FIG. 6C. Fasteners may be pins, staples, stitching, rivets, glue, any other conventional fastener, or any combination thereof. Fastening the ribbon in a particular configuration may also be accomplished by the application of heat (such as from a wood burning device). The application of heat may melt the ribbon in specific areas, thereby securing the ribbon in a particular configuration. In some embodiments, the fastening of ribbon occurs in an area over a slot, over a combination element, or both, in the size guide. Therefore, ribbon is secured to itself, but is not secured to the size guide, and may be easily removed from the size guide.

Once removed from the size guide, configured ribbon may be further modified to achieve the desired bow type. For example, configured ribbon may be tied and/or cinched in the middle through employment of a tying element, such as a length of thread, string, ribbon and/or wire. As another example, configured ribbon may be transferred to a provided bow crafting template and further folded to form a bow.

V. Methods of Crafting Bows Using Bow Crafting Template and Bow Crafting Size Guide As illustrated and described herein and in FIGS. 5-6, a provided ribbon (or any other suitable elongated article) may be made into a bow through utilization of a provided size guide or a provided bow crafting template. Bows may also be crafted through utilization of both a provided size guide and a provided bow crafting template.

For illustrative purposes, certain embodiments of how ribbon (or any other suitable elongated article) may be manipulated and secured into a bow structure using the provided tools are described. However, one of skill will appreciate that a variety of steps and combinations thereof may be used to craft a bow using the provided tools, and that the selection of steps will depend upon the particular bow design desired.

As one example, a length of ribbon may be provided and positioned across the provided size guide body between two ribbon positioning surfaces. In some embodiments, a length of ribbon may be positioned across only a portion of the size guide body, said positioning aided by one ribbon positioning surface. In some embodiments, a combination of the aforementioned steps are used to fold the ribbon such that loop size, loop angle, loop symmetry, or combinations thereof, are in the correct configuration for the intended bow type. One or more fasteners may be utilized to secure the ribbon in such configuration. Fasteners may be pins, staples, stitching, rivets, glue, any other conventional fastener, or any combination thereof. Fastening the ribbon in a particular configuration may also be accomplished by the application of heat (such as from a wood burning device). The application of heat may melt the ribbon in specific areas, thereby securing the ribbon in a particular configuration. In some embodiments, the fastening of ribbon occurs in an area over a slot in the size guide. Therefore, ribbon is secured to itself, but is not secured to the size guide, and may be easily removed from the size guide.

Once removed from the size guide, configured ribbon may be further modified to achieve the desired bow type. For example, configured ribbon may be transferred to a provided bow crafting template and further folded to form a bow. The transferred configured ribbon may be positioned across the template body between two ribbon positioning surfaces, and loosely held in such position by two pair of ribbon securing elements. In some embodiments, a length of the transferred configured ribbon may be positioned across only a portion of the template body, said positioning aided by one positioning surface and one pair of ribbon securing elements. In some embodiments, a combination of the aforementioned steps is used to form the ribbon into a bow configuration. One or more fasteners may be utilized to secure the ribbon in such configuration. In some embodiments, the fastening of ribbon occurs in an area over an aperture of the template. Therefore, ribbon is secured to itself, but is not secured to the template, and may be easily removed from the template.

Once removed from the template, configured ribbon may be further modified to achieve the desired bow type. For example, configured ribbon may be tied and/or cinched in the middle through employment of a tying element, such as a length of thread, string, ribbon and/or wire.

The foregoing description of various embodiments of the invention has been presented for the purposes of illustration and description. It is not intended to be exhaustive or to limit the invention to the precise form disclosed. Many alternatives, modifications and variations will be apparent to those skilled in the art of the above teaching. Accordingly, while some of the diverse embodiments of the tools have been discussed specifically, other embodiments will be apparent or relatively easily developed by those of ordinary skill in the art. Accordingly, this invention is intended to embrace all alternatives, modifications and variations that have been discussed herein, and others that fall within the spirit and broad scope of the claims.

What is claimed is:

1. A method of crafting a bow, comprising:

providing a length of ribbon;

providing a bow crafting size guide, said guide comprising (i) a non-rectangular body having (a) a front face, (b) a back face, and (c) a plurality sides defined between the front and back faces; (ii) a plurality of ribbon positioning surfaces; (iii) at least one slot defined within the body; and (iv) optionally, a combination element comprising at least one ribbon positioning surface and at least one slot;

providing a bow crafting template, said template comprising (i) a non-rectangular body having (a) a front face, (b) a back face, and (c) a plurality sides, each side defining a ribbon positioning surface between the front and back faces; (ii) a plurality of ribbon securing elements, each being located between two ribbon positioning surfaces; and (iii) optionally, one or more apertures defined within the body;

placing a length of ribbon across the provided size guide between one or more ribbon positioning surfaces;

folding the length of ribbon such that loop size loop angle, loop symmetry, or combinations thereof are in a correct configuration for the intended bow type;

utilizing one or more optional fasteners to secure the length of ribbon to itself in the correct configuration;

transferring the length of ribbon from the size guide to the template, wherein the length of ribbon is placed across the provided template between one or more ribbon positioning surfaces and loosely held in place by one or more pair of ribbon securing elements;

utilizing one or more optional fasteners to secure the length of ribbon to itself in the correct configuration; and removing the length of ribbon from the template and completing the bow.

2. A method according to claim 1, wherein the provided size guide has at least one combination element, and at least two of the plurality of sides are ribbon positioning surfaces.

3. A method according to claim 2, wherein the provided size guide has thirteen sides and thirteen ribbon positioning surfaces, at least one ribbon positioning surface not being a side.

4. A method according to claim 3, wherein the provided size guide has eight slots.

5. A method according to claim 1, wherein each ribbon securing element of the provided template comprises a first positioning element and a second positioning element, each positioning element being elevated over one ribbon positioning surface.

6. A method according to claim 5, wherein the provided template has six ribbon securing elements and six ribbon positioning surfaces.

7. A method according to claim 6, wherein the body of the provided template is substantially hexagonal in shape and has one substantially rectangular aperture defined therein.

8. A method according to claim 1, wherein the length of ribbon is fastened in an area over a slot in the size guide.

9. A method according to claim 1, wherein the length of ribbon is fastened by the application of heat in one or more areas to secure the ribbon in a particular configuration.

10. A method according to claim 1, wherein the length of ribbon is fastened in an area over an aperture of the template.

11. A method according to claim 1, wherein the bow is completed by being tied or cinched in the middle through employment of a tying element, comprising a length of thread, string, ribbon, or wire.

* * * * *